US010276292B2

(12) United States Patent
Fujii et al.

(10) Patent No.: US 10,276,292 B2
(45) Date of Patent: Apr. 30, 2019

(54) ELECTRONIC MODULE WITH POLYGONAL CORE INSERTION HOLE

(71) Applicant: FDK CORPORATION, Minato-ku, Tokyo (JP)

(72) Inventors: Yohei Fujii, Tokyo (JP); Makoto Okamoto, Tokyo (JP); Masayoshi Kimura, Tokyo (JP); Toshimasa Sugihara, Tokyo (JP)

(73) Assignee: FDK CORPORATION, Tokyo (JP)

( * ) Notice: Subject to any disclaimer, the term of this patent is extended or adjusted under 35 U.S.C. 154(b) by 0 days.

(21) Appl. No.: 15/080,283

(22) Filed: Mar. 24, 2016

(65) Prior Publication Data

US 2016/0284464 A1 Sep. 29, 2016

(30) Foreign Application Priority Data

Mar. 27, 2015 (JP) ..... 2015-066582

(51) Int. Cl.
*H01F 27/28* (2006.01)
*H01F 27/30* (2006.01)

(52) U.S. Cl.
CPC ..... *H01F 27/2804* (2013.01); *H01F 27/306* (2013.01); *H01F 2027/2809* (2013.01)

(58) Field of Classification Search
CPC ..... H01F 2027/2809
See application file for complete search history.

(56) References Cited

U.S. PATENT DOCUMENTS 3,148,356 A * 9/1964 Hedden, Jr. ..... H01R 12/526 336/200
6,073,339 A * 6/2000 Levin ..... H01F 17/0013 336/200
7,613,021 B2 * 11/2009 Lanni ..... G06F 1/26 363/147
9,633,772 B2 * 4/2017 Turnbull ..... H01F 17/0006
2007/0072447 A1 * 3/2007 Busletta ..... H05K 1/165 439/68
2009/0295528 A1 * 12/2009 Silva ..... H01F 3/10 336/200

(Continued)

FOREIGN PATENT DOCUMENTS

JP H1032129 A * 2/1998 ..... H01F 17/00
JP 1998032129 A 3/1998

(Continued)

*Primary Examiner* — Mang Tin Bik Lian
*Assistant Examiner* — Malcolm Barnes
(74) *Attorney, Agent, or Firm* — Kinney & Lange, P.A.

(57) ABSTRACT

An electronic module is provided with a circuit board including a central-axis insertion hole and composed by laminating a multitude of wiring layers; and a core formed of a magnetic material and inserted through the central-axis insertion hole, wherein the circuit board includes a plurality of coil wiring patterns formed in positions of the respective wiring layers surrounding the core insertion hole; and edge-face through-holes formed on inner wall surfaces of the central-axis core insertion hole to electrically connect the plurality of coil wiring patterns to form a coil, the central-axis insertion hole has a octagon shape in plan view, concave portions are disposed on the inner wall surfaces corresponding to sides of the octagon shape, and the edge-face through-holes are formed in the concave portions.

1 Claim, 9 Drawing Sheets

(56) References Cited

U.S. PATENT DOCUMENTS

| | | | | |
|---|---|---|---|---|
| 2010/0117777 | A1* | 5/2010 | Tan | H01F 27/292 336/65 |
| 2011/0037405 | A1* | 2/2011 | Suganuma | H01F 27/2804 336/200 |
| 2014/0042226 | A1* | 2/2014 | Lee | H01Q 9/16 235/449 |
| 2015/0179334 | A1* | 6/2015 | Jeong | H01F 27/2885 336/84 C |
| 2015/0235757 | A1* | 8/2015 | Lovell | H05K 1/0254 336/84 C |

FOREIGN PATENT DOCUMENTS

| | | | | |
|---|---|---|---|---|
| JP | 2012-134291 | A | 7/2012 | |
| JP | 2012134291 | A * | 7/2012 | H01F 30/00 |

* cited by examiner

ELECTRONIC MODULE WITH POLYGONAL CORE INSERTION HOLE

BACKGROUND OF THE INVENTION

Field of the Invention

The present invention relates to an electronic module, and more specifically, to an electronic module including a multilayer board into which a core and a coil are assembled.

Description of the Related Art

A DC-DC converter is known as a type of electronic module formed by mounting various electronic components on a board. In a commonly-known DC-DC converter, a transformer and an inductor which are core/coil components formed by combining a core composed of a magnetic material and a coil are surface-mounted on a board.

In recent years, thickness and size reductions have been a critical issue in equipment into which a DC-DC converter is assembled. Accordingly, DC-DC converters are also desired to be reduced in size.

Hence, attempts are being made to reduce the height of core/coil components, among electronic components to be mounted on a DC-DC converter, which are components comparatively large in height. Here, a transformer which adopts a laminated coil formed by stacking a plurality of thin laminar sheet coils is available as a transformer the height of which is kept low. As such a transformer, there has been known a transformer mounted on an electronic circuit device shown in, for example, Japanese Patent Laid-Open No. 2012-134291.

In the transformer disclosed in this Japanese Patent Laid-Open No. 2012-134291, an electrical conductor arranged in each laminar sheet coil is electrically connected through a connection hole wiring (through-hole wiring or via wiring) buried in a connection hole created in each laminar sheet coil.

Incidentally, attempts are being made to directly assemble such a transformer as mentioned above into the multilayer board of a DC-DC converter, in order to cope with a further decrease in thickness. Specifically, a core insertion hole to insert a core through is arranged in a predetermined region of the multilayer board serving as a base of the DC-DC converter. Then, a coil wiring pattern to serve as part of the coil is formed in each layer, so as to surround this core insertion hole. In addition, a coil wiring pattern in each layer is electrically connected through a connection hole wiring, i.e., a through-hole wiring or a via wiring, buried in a connection hole arranged in each layer, as in the transformer disclosed in Japanese Patent Laid-Open No. 2012-134291. The coil is thus formed in the multilayer board. In addition, a transformer is formed in the multilayer board as the result of the core being inserted through the abovementioned core insertion hole. In this case, dimensions in the thickness direction of the board are further reduced since the transformer is directly assembled into the multilayer board, thereby contributing to thinning the DC-DC converter.

In the multilayer board into which such a transformer as described above is assembled, through-hole wirings and the like for connecting the coil wiring patterns of respective layers are generally formed in a region where other electronic components are to be mounted. Other electronic components are mounted so as to avoid trespassing on these through-hole wirings.

Incidentally, there are also demands for the size reduction of DC-DC converters and the high densification of electronic components to be mounted on the converters. If through-hole wirings and the like are present in a region where the electronic components are mounted as described above, however, an area of a board surface available for the electronic components to be mounted decreases, thus making it difficult to meet these demands.

Hence, so-called edge-face through-holes are formed on inner wall surfaces of the core insertion hole, in place of the abovementioned through-hole wirings and the like, to electrically connect the coil wiring patterns of respective layers using these edge-face through-holes. This method does not disturb the mounting of other electronic components, and therefore, contributes to the size reduction and high-density packaging of DC-DC converters.

The edge-face through-holes face the core, however, and therefore may come into contact with the core to cause short-circuiting. In addition, the inner wall surfaces of the core insertion hole are curved so as to be conformal to the outer shape of the column-shaped core. If the edge-face through-holes are formed on such curved surfaces as described above, burrs are liable to arise in the course of forming the holes. If any burrs containing portions of the conductor of the edge-face through-holes, short-circuiting is more likely to occur.

An object of the present invention, which has been accomplished in view of the above-described circumstances, is to provide an electronic module capable of preventing short-circuiting between a core and an edge-face through-hole.

SUMMARY OF THE INVENTION

According to the present invention, there is provided an electronic module provided with a multilayer board including a core insertion hole and composed by laminating a multitude of wiring layers; and a core formed of a magnetic material and inserted through the core insertion hole, wherein the multilayer board includes a plurality of coil wiring patterns formed in positions of the respective wiring layers surrounding the core insertion hole; and edge-face through-holes formed on inner wall surfaces of the core insertion hole to electrically connect the plurality of coil wiring patterns to form a coil, the core insertion hole has a polygonal shape in plan view, concave portions are disposed on inner wall surfaces corresponding to sides of the polygonal shape, and the edge-face through-holes are formed in the concave portions.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Illustrative embodiments of a DC-DC converter (hereinafter referred to as a converter) 2 serving as an electronic module to which the present invention is applied will be described hereinafter, while referring to the accompanying drawings.

Figure 1:
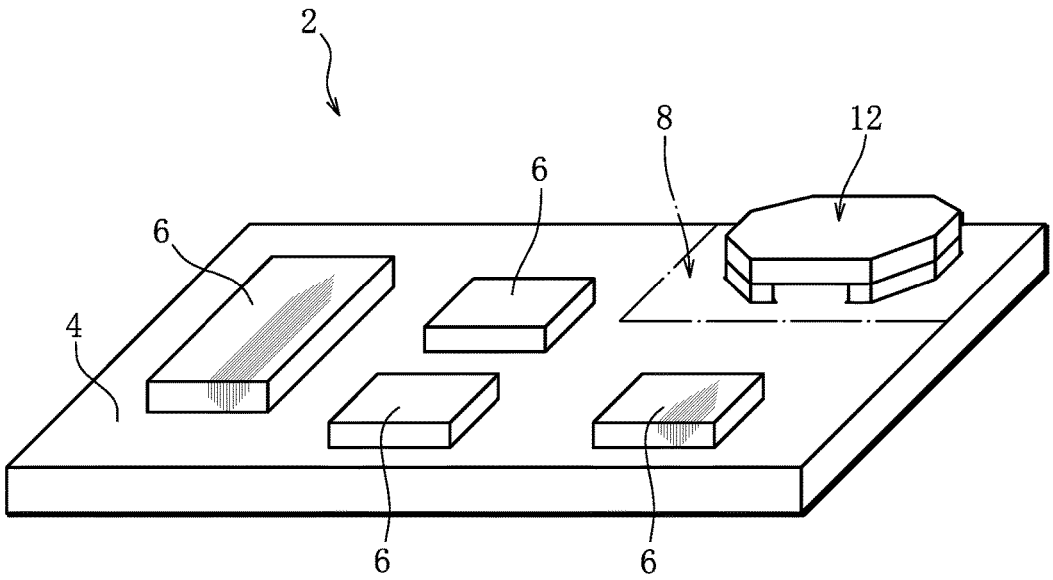
FIG. 1 is a perspective view illustrating an electronic module according to an embodiment of the present invention.

As illustrated in FIG. 1, the converter 2 includes a circuit board 4; electronic components 6 mounted on a surface of this circuit board 4; and a core/coil region 8 assembled into a portion of this circuit board 4.

The circuit board 4 is a multilayer board made by laminating insulators and wiring patterns in a wafery manner. The electronic components 6 mounted on a surface of this circuit board 4 are various types of electronic functional components (LSIs and the like) having functions necessary to configure the converter 2.

The core/coil region 8 is a portion surrounded by a virtual line in FIG. 1 and serves the functions of an inductor. In this portion, a coil is disposed within the circuit board 4, and a core 12 forming an inductor in conjunction with this coil is assembled into the circuit board 4.

Figure 2:
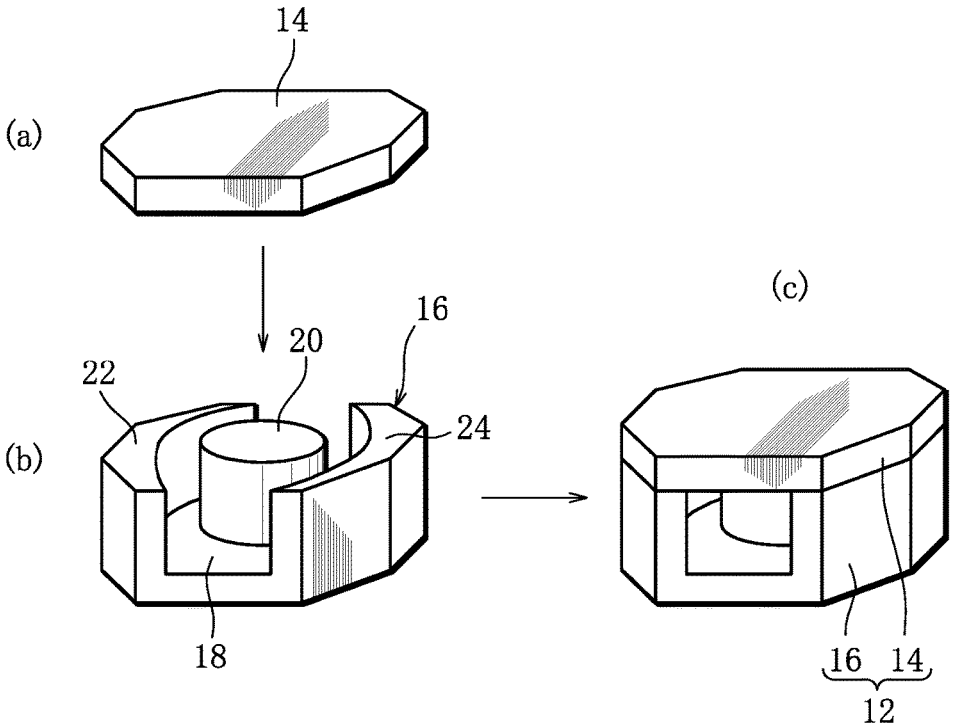
FIG. 2 is a perspective view illustrating the structure of a core.

The core 12 is formed from ferrite and includes a cover plate 14 and a main unit 16, as illustrated in FIG. 2.

The cover plate 14 is a plate-like body octagon-shaped in plan view, as illustrated in FIG. 2(*a*).

The main unit 16 includes a bottom plate 18 octagon-shaped in plan view as the cover plate 14, as illustrated in FIG. 2(*b*); a column-shaped central axis 20 disposed in the center of this bottom plate 18; and a pair of sidewalls 22 and 24 extending upward from the side surfaces of the bottom plate 18, so as to surround this central axis 20. The cover plate 14 and the main unit 16 are stacked and fixed using, for example, an adhesive agent, thus forming into such a core 12 as illustrated in FIG. 2(*c*).

In this core 12, the central axis 20 and the sidewalls 22 and 24 are fitted into a central-axis insertion hole 26 and sidewall cutouts 28 and 30, respectively, arranged in predetermined locations of the core/coil region 8 of the circuit board 4. Under that condition, the cover plate 14 is fixed to the main unit 16 and thus the core 12 is assembled into the circuit board 4.

Next, the coil disposed in the circuit board 4 will be described. Since illustrative embodiments of this coil will become apparent when a procedure to produce the core/coil region 8 is described, the coil will be described along with such a procedure of production.

The circuit board 4 is manufactured using a commonly-known method for manufacturing multilayer boards, for example, a buildup process. Here, epoxy resin or polyimide, for example, is used as a material of the abovementioned insulators. In addition, copper, for example, is used as a material of the wiring patterns.

First, an interim product 72 of the circuit board 4 in which a wiring pattern is formed in each layer is obtained using a buildup process.

In this interim product 72, a coil wiring pattern 32 is arranged in the core/coil region 8 simultaneously with other wiring patterns in the course of manufacture of the above-mentioned multilayer board. Illustrative embodiments of the coil wiring pattern 32 in each layer and the surroundings of the pattern will be described hereinafter. Here, the coil in the present embodiment includes three layers of coil wiring patterns 32.

Figure 3:
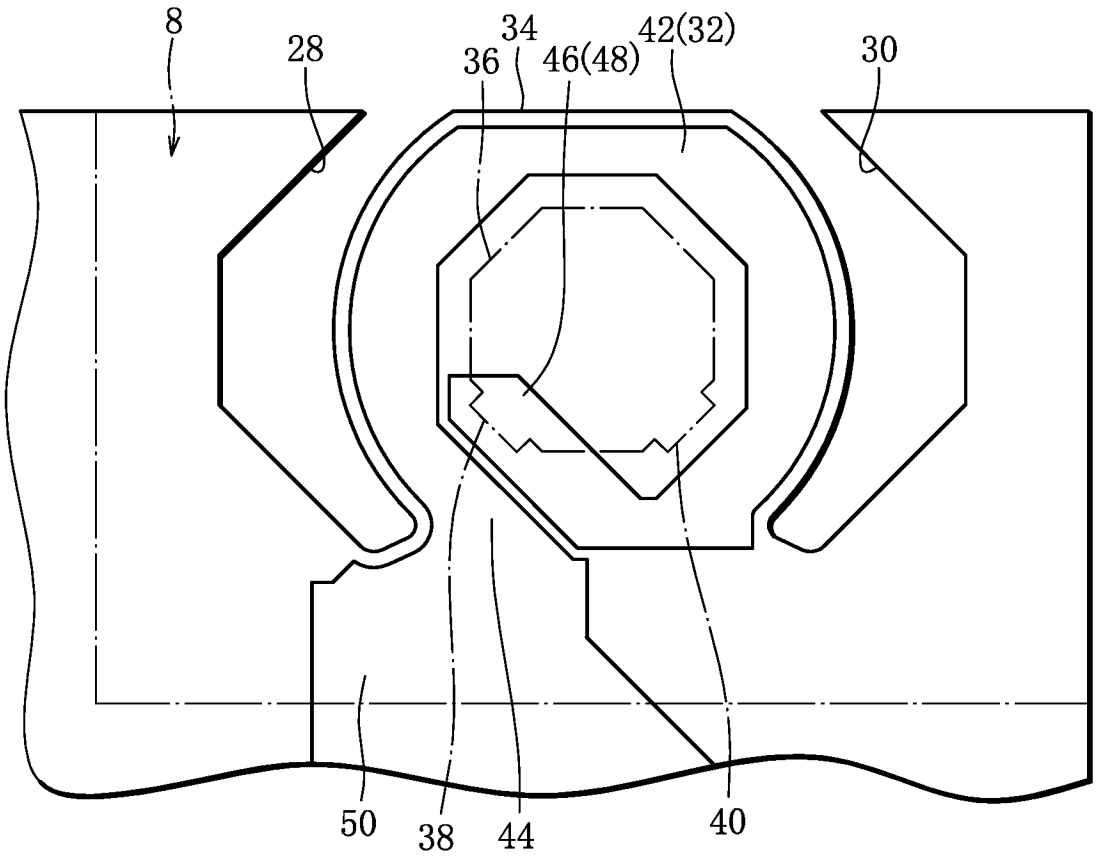
FIG. 3 is a plan view illustrating the core/coil region of a first layer.

As illustrated in FIG. 3, the sidewall cutouts 28 and 30 through which the sidewalls 22 and 24 of the core 12 are inserted are disposed in a portion corresponding to the core/coil region 8 of the first layer. In addition, a coil-forming portion 34 composed of an insulator positioned between these sidewall cutouts 28 and 30 is present in the portion. A portion 36 for planned hole formation, where the central-axis insertion hole 26 through which the central axis 20 of the core 12 is inserted is to be formed, is present in the center of this coil-forming portion 34.

Here, a description will be made of the shape of the portion 36 for planned hole formation, i.e., the shape of the central-axis insertion hole 26. This central-axis insertion hole 26 is polygon-shaped and substantially octagon-shaped in the present embodiment. Specifically, sides 38 and 40, among the eight sides of an octagon, positioned diagonally downward left and diagonally downward right are disposed in a direction away from the central axis 20 of the core 12, i.e., arranged so as to retreat outward in the radial direction of the central axis 20. That is, such retreated two sides 38 and 40 are positioned so as to be able to avoid coming into contact with the central axis 20 when the central axis 20 of the core 12 is inserted through the central-axis insertion hole 26. Here, the left-side retreated side is defined as a first retreated side 38 in FIG. 3, whereas the right-side retreated side on the right is defined as a second retreated side 40. Note that it does not matter if sides other than these retreated two sides come into contact with the central axis 20 of the core 12.

A spiral first coil wiring 42 is formed in the coil-forming portion 34 of the first layer, so as to surround the above-mentioned portion 36 for planned hole formation. This first coil wiring 42 spirally makes a circuit of the coil-forming portion 34, so as to extend clockwise from a base end portion 44 positioned on the left side of the neck of the coil-forming portion 34. In addition, a leading-end portion 46 of the first coil wiring 42 is positioned near the base end portion 44 at the starting point of winding, i.e., in a location where the leading-end portion 46 overlaps with the abovementioned first retreated side 38. This leading-end portion 46 serves as a first connecting portion 48. Note that the base end portion 44 of the first coil wiring 42 is connected to a predetermined wiring pattern 50 of the circuit board 4.

Figure 4:
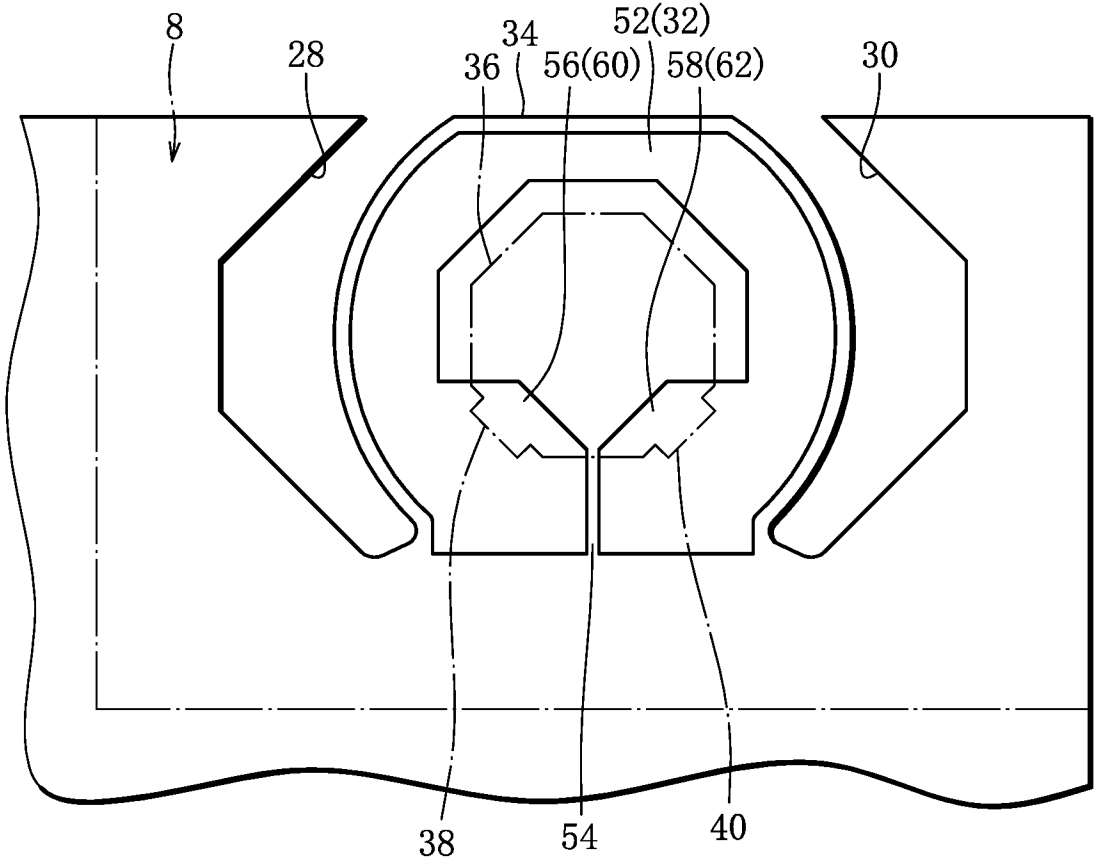
FIG. 4 is a plan view illustrating the core/coil region of a second layer.

As illustrated in FIG. 4, sidewall cutouts 28 and 30 and a coil-forming portion 34 are disposed in a portion of the second layer corresponding to the core/coil region 8 as in the first layer. As illustrated in FIG. 4, a second coil wiring 52 in the second layer is disposed on the coil-forming portion 34, so as to surround a portion 36 for planned hole formation the same in shape as the portion 36 for planned hole formation in the first layer. As is evident from FIG. 4, however, this second coil wiring 52 has an annular shape including a straight cutout 54 formed by cutting out part of the wiring straight. In addition, a left-side projecting portion 56 and a right-side projecting portion 58 projecting toward the side of the portion 36 for planned hole formation are disposed on the left and right sides of this straight cutout 54, so as to overlap with the first retreated side 38 and the second retreated side 40. Here, the left-side projecting portion 56 serves as a second connecting portion 60, whereas the right-side projecting portion 58 serves as a third connecting portion 62.

Figure 5:
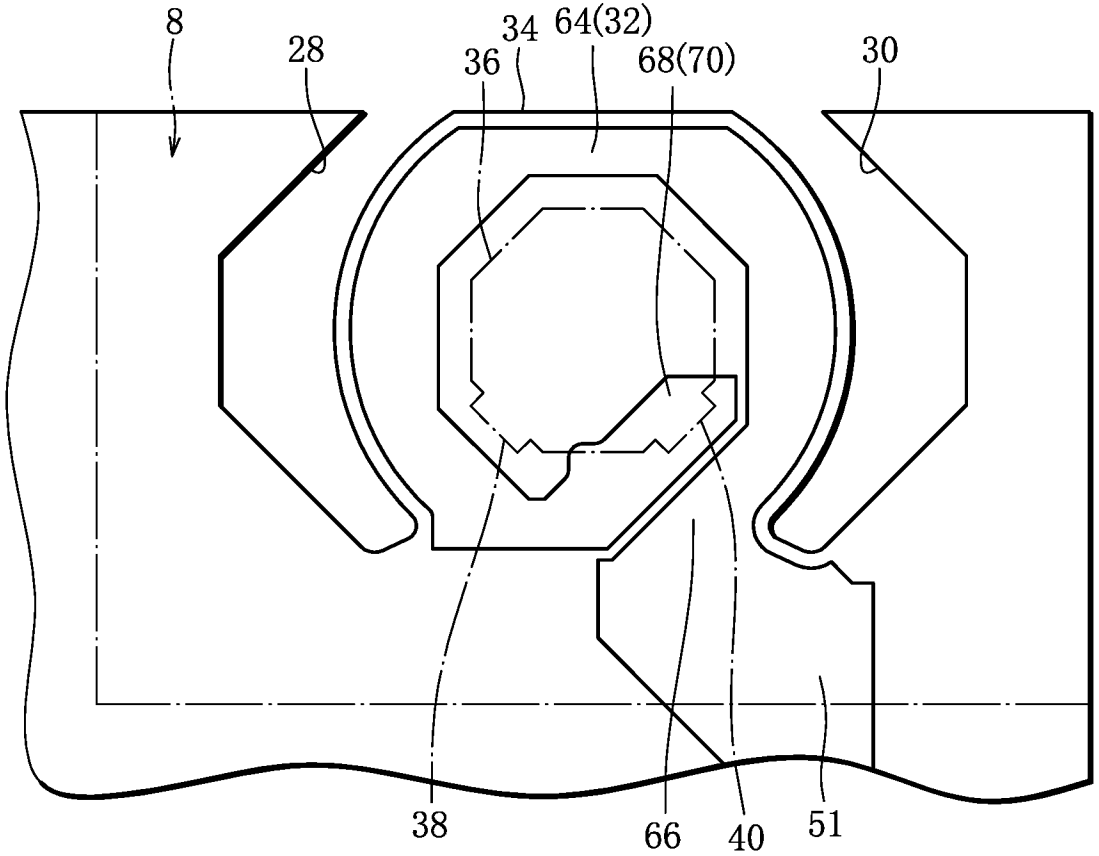
FIG. 5 is a plan view illustrating the core/coil region of a third layer.

As illustrated in FIG. 5, sidewall cutouts 28 and 30 and a coil-forming portion 34 are disposed in a portion of the third layer corresponding to the core/coil region 8 as in the first and second layers. A spiral third coil wiring 64 is formed in the coil-forming portion 34 of the third layer, so as to surround a portion 36 for planned hole formation the same in shape as the portion 36 for planned hole formation in the first layer. As is evident from FIG. 5, this third coil wiring 64 in the third layer spirally makes a circuit of the coil-forming portion 34, so as to extend counterclockwise from a base end portion 66 positioned on the right side of the neck of the coil-forming portion 34. In addition, the leading-end portion 68 of the third coil wiring 64 is positioned near the base end portion 66 at the starting point of winding, i.e., in a location where the leading-end portion 68 overlaps with the abovementioned second retreated side 40. This leading-end portion 68 serves as a fourth connecting portion 70. Note that the base end portion 66 of the third coil wiring 64 is connected to a predetermined wiring pattern 51 of the circuit board 4.

As described above, in the core/coil region 8 of the interim product 72, these first coil wiring 42, second coil wiring 52 and third coil wiring 64 are stacked in this order and integrated into one unit with an insulator (coil-forming portion 34) interposed between each two of the wirings. In addition, the first connecting portion 48 of the first coil wiring 42 and the second connecting portion 60 of the second coil wiring 52 overlap with each other, and the third connecting portion 62 of the second coil wiring 52 and the fourth connecting portion 70 of the third coil wiring 64 overlap with each other.

A hole-drilling process is then performed on the interim product 72 under such a condition as described above. Specifically, a first through-hole 74 penetrating through the first layer to the third layer is arranged in a position overlapping with the first retreated side 38 of the above-mentioned portion 36 for planned hole formation, and a second through-hole 76 penetrating through the first layer to the third layer is arranged in a position overlapping with the second retreated side 40 of the abovementioned portion 36 for planned hole formation.

Figure 6:
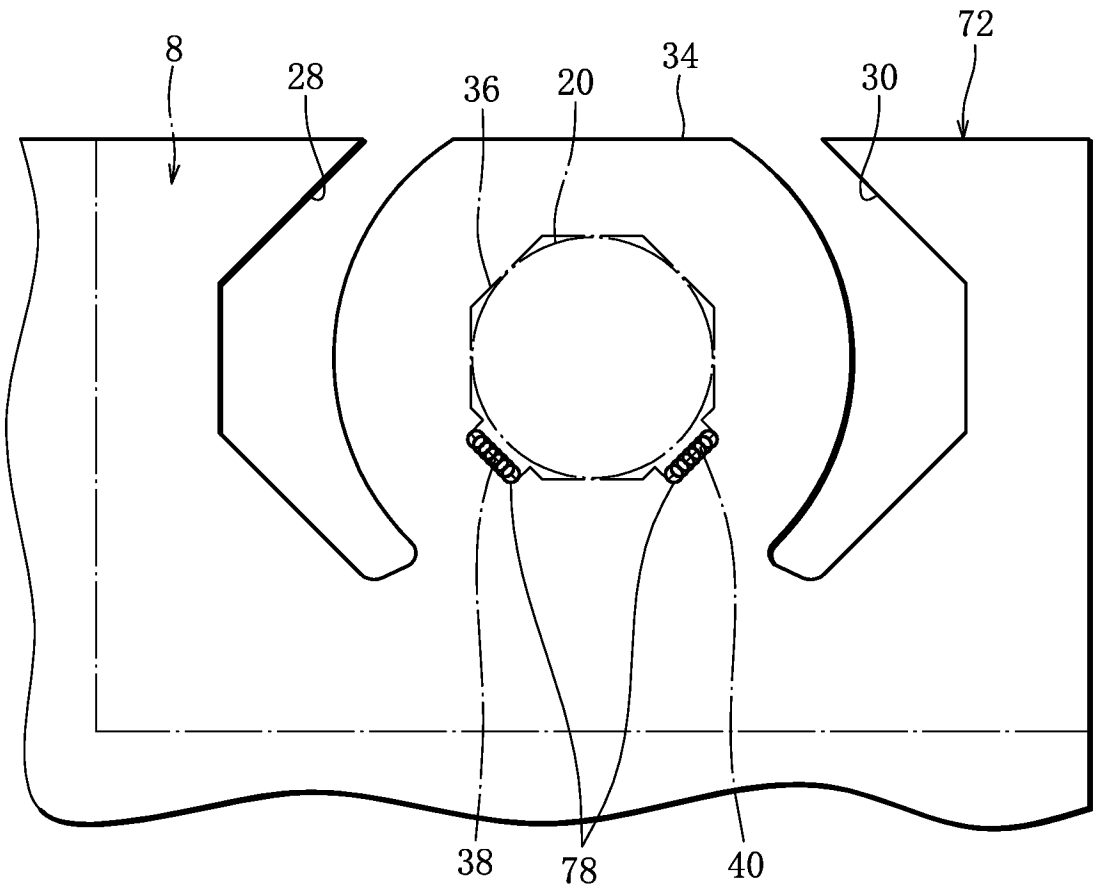
FIG. 6 is a plan view illustrating an interim product in which through-holes are formed.
Figure 7:
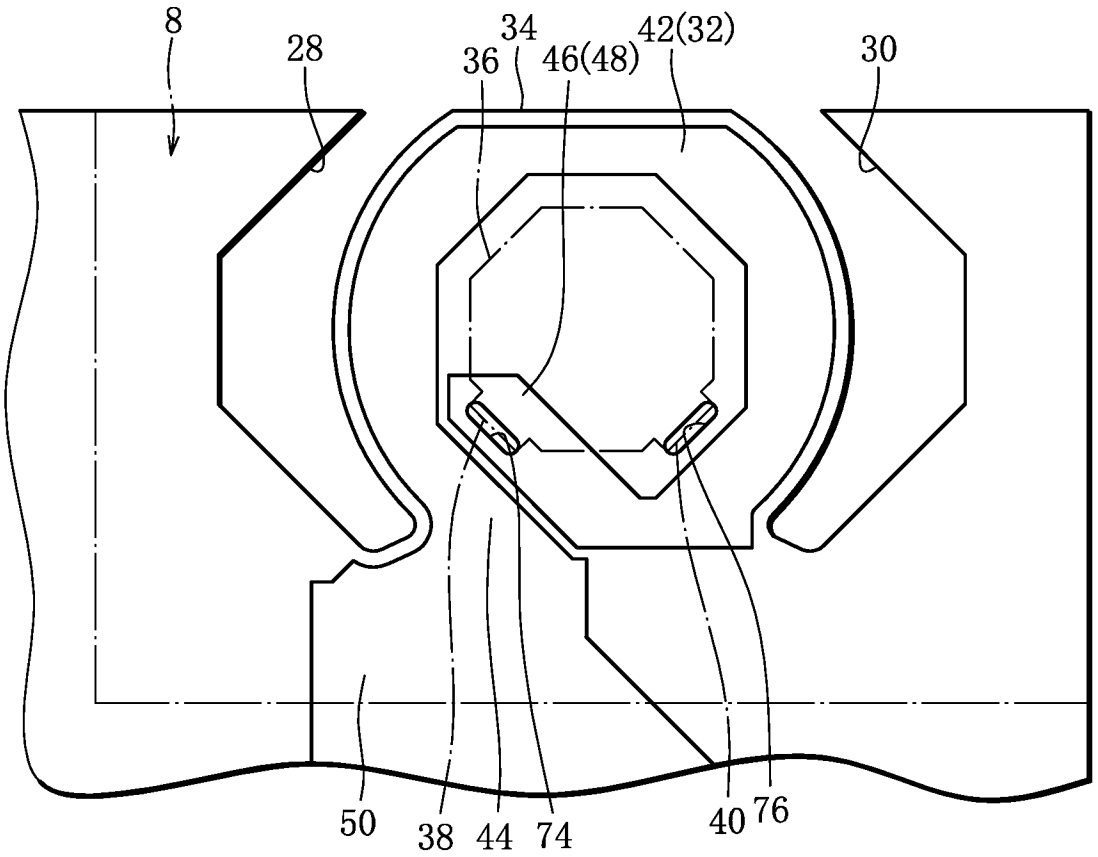
FIG. 7 is a plan view illustrating the core/coil region of the first layer in which through-holes are formed.
Figure 8:
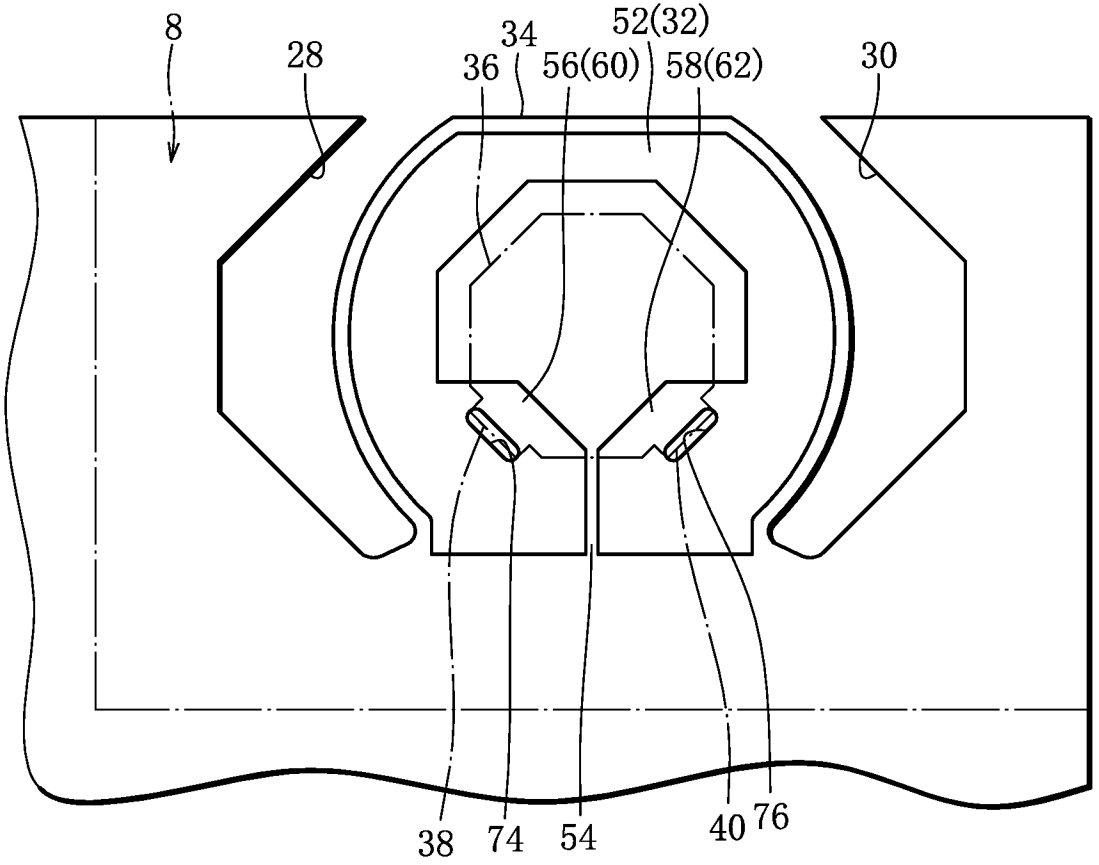
FIG. 8 is a plan view illustrating the core/coil region of the second layer in which through-holes are formed.
Figure 9:
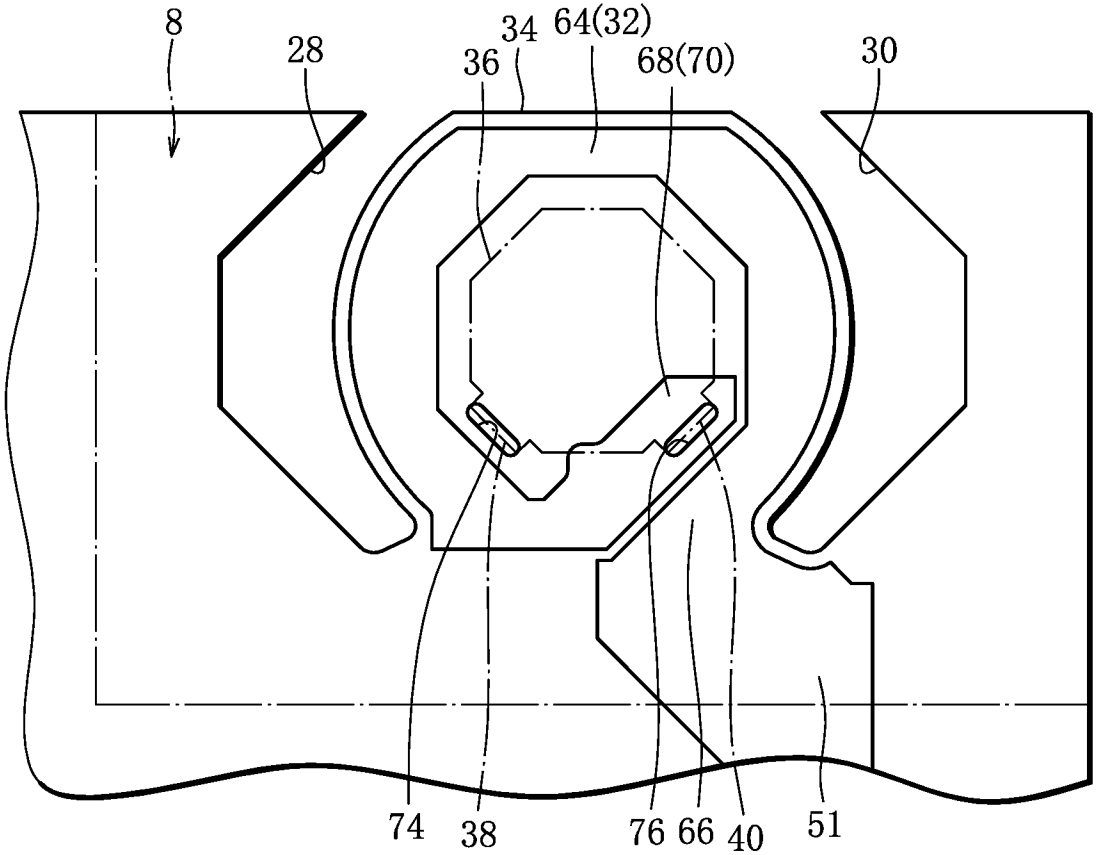
FIG. 9 is a plan view illustrating the core/coil region of the third layer in which through-holes are formed.

In the present embodiment, a plurality of circular through-holes 78 is created along the first retreated side 38 as illustrated in FIG. 6. At this time, the respective through-holes 78 are disposed so as to partially overlap with one another, and that the center of each through-hole 78 is positioned on the first retreated side 38. A plurality of circular through-holes 78 is also created along the second retreated side 40 in the same way as with the first retreated side 38. Consequently, a long hole-shaped first through-hole 74 and a long hole-shaped second through-hole 76 are formed in the interim product 72. FIGS. 7 to 9 show the illustrative embodiment of each layer in which these first and second through-holes 74 and 76 are disposed.

In the first layer, the first through-hole 74 is positioned in the first connecting portion 48, as is evident from FIG. 7. Consequently, the first coil wiring 42 of the first connecting portion 48 becomes exposed on the inner walls of the first through-hole 74. On the other hand, the second through-hole 76 is positioned in a predetermined location of the coil-forming portion 34 without overlapping with the first coil wiring 42.

In the second layer, the first through-hole 74 is positioned in the second connecting portion 60, and the second through-hole 76 is positioned in the third connecting portion 62, as is evident from FIG. 8. Consequently, the second coil wiring 52 becomes exposed on the inner walls of the first through-hole 74 and second through-hole 76.

In the third layer, the second through-hole 76 is positioned in the fourth connecting portion 70, as is evident from FIG. 9. Consequently, the third coil wiring 64 of the fourth connecting portion 70 becomes exposed on the inner walls of the second through-hole 76. On the other hand, the first through-hole 74 is positioned in a predetermined location of the coil-forming portion 34 without overlapping with the third coil wiring 64.

Next, copper plating is performed on the inner walls of the first through-hole 74 and second through-hole 76 using a heretofore-known method to form conduction vias. These conduction vias electrically interconnect respective inter-layer wirings. In the present embodiment, the first connecting portion 48 of the first coil wiring 42 and the second connecting portion 60 of the second coil wiring 52 are electrically connected to each other by the conduction via of the first through-hole 74. In addition, the third connecting portion 62 of the second coil wiring 52 and the fourth connecting portion 70 of the third coil wiring 64 are electrically connected to each other by the conduction via of the second through-hole 76. Consequently, the first coil wiring 42, the second coil wiring 52 and the third coil wiring 64 are electrically connected, thereby interlinking the three layers of the coil wiring patterns 32 and forming a three-winding coil.

Next, a punching process is performed on the portions 36 for planned hole formation of the interim product 72 in which the coil is formed to create a central-axis insertion hole 26. Here, the central-axis insertion hole 26 has a substantially octagonal shape including the first retreated side 38 and the second retreated side 40, as described above. In addition, the first retreated side 38 and the second retreated side 40 overlap with the first through-hole 74 and the second through-hole 76, and therefore, the first through-hole 74 and the second through-hole 76 are scraped away approximately in half, thus forming so-called edge-face through-holes 78. That is, concave portions 77 are disposed on inner wall surfaces corresponding to sides of the octagon shape, and the edge-face through-holes 78 are formed in these concave portions 77. Here, an edge-face through-hole refers to an interlayer wiring in which a concave groove arranged on an edge face of a board is covered with an electrical conductor to electrically connect the circuit patterns of respective layers.

In the interim product 72 in which the central-axis insertion hole 26 is formed in this way, the central axis 20 of the main unit 16 of the core 12 is inserted through the central-axis insertion hole 26, and the sidewalls 22 and 24 are inserted through the sidewall cutouts 28 and 30, in the first place. Thereafter, the cover plate 14 is bonded and fixed to the upper portions of the central axis 20 and sidewalls 22 and 24 protruding from the upper surface of the circuit board 4, and thus the core 12 is assembled into the circuit board 4. Consequently, an inductor is formed in the circuit board 4.

Thereafter, other electronic components 6 and the like are mounted on the circuit board 4, thereby obtaining the converter 2 according to the present invention.

Figure 10:
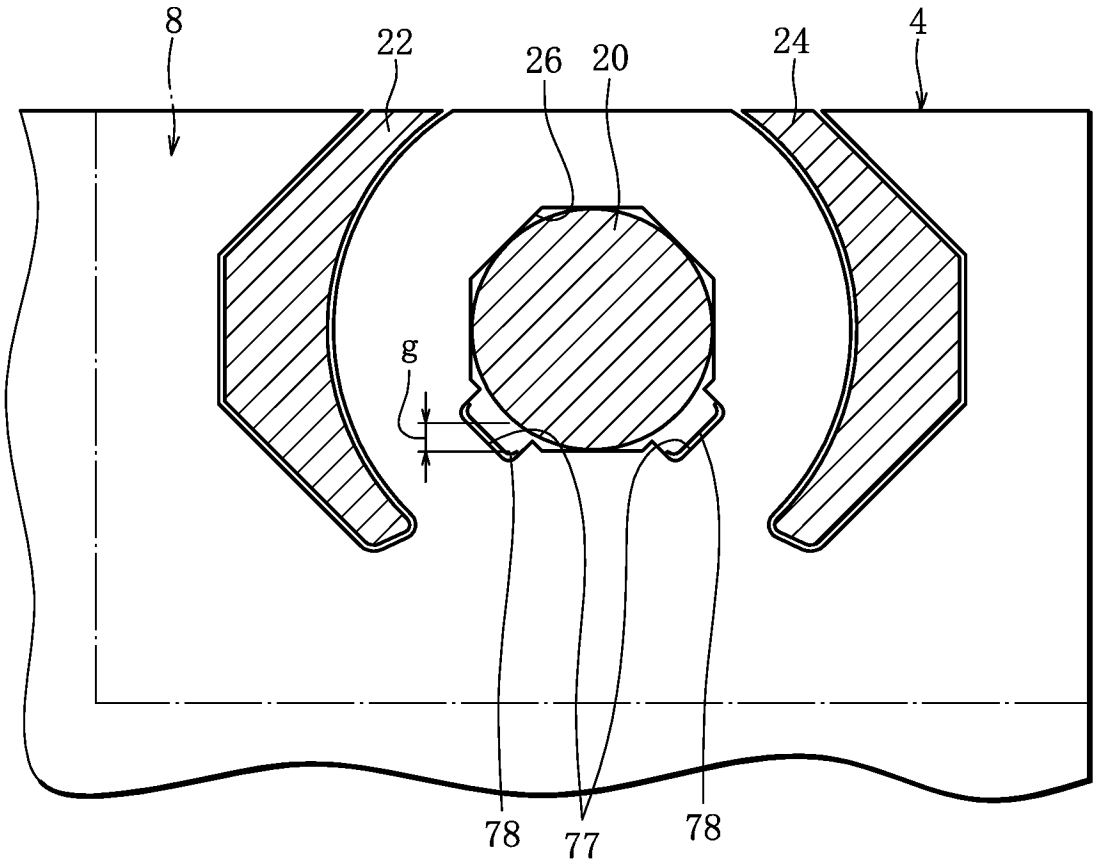
FIG. 10 is a plan view illustrating a circuit board in which edge-face through-holes are formed.

In the circuit board 4 of the converter 2 according to the present invention, the central-axis insertion hole 26 does not have a conventional circular shape but has a substantially octagonal (polygonal) shape composed of rectilinear sides, as is evident from FIG. 10. The edge-face through-holes 78 can therefore be formed in rectilinear portions of the central-axis insertion hole 26. Thus, it is possible to prevent burrs from being produced at the time of punching.

In addition, the edge-face through-holes 78 are formed on the edges of the central-axis insertion hole 26 rather than in the portion where the other electronic components 6 are mounted. Accordingly, it is possible to widen the area of the portion where the other electronic components 6 can be mounted. This configuration contributes to reducing the size of the circuit board 4 and increasing the packaging density of electronic components to be mounted.

Yet additionally, the edge-face through-holes 78 are formed on the retreated sides of the octagon-shaped central-axis insertion hole 26. That is, the edge-face through-holes 78 are provided in the concave portions 77 disposed on the inner wall surfaces of portions of the octagon-shaped central-axis insertion hole 26 corresponding to sides of the octagon shape. Consequently, the edge-face through-holes 78 are positioned in locations retreated in a direction away from the central axis 20 of the core 12. As a result, a gap g can be created between each of the edge-face through-holes 78 and the central axis 20 of the core 12. Thus, it is possible to prevent short-circuiting between the core 12 and each of the edge-face through-hole 78.

It should be noted that the present invention is not limited to the above-described embodiments but may be modified in various other ways. Although the central-axis insertion hole is octagon-shaped in the above-described embodiments, the number of corners is not limited in particular. The central-axis insertion hole may be a polygon having more than eight corners or less than eight corners. In these cases, concave portions may be disposed on the inner wall surfaces of portions of the insertion hole corresponding to sides of the polygonal shape, and the edge-face through-holes may be formed in these concave portions.

As described above, the core insertion hole is polygon-shaped in plan view in the present invention. Accordingly, a cutting plane of the core insertion hole is rectilinear when the core insertion hole is formed in a multilayer board. Consequently, it is possible to reduce the possibility of burrs of an electrical conductor from being produced on inner wall surfaces of the core insertion hole where the edge-face through-holes are formed. Accordingly, it is possible to reduce the possibility of the outer circumferential surface of a core from coming into contact with the edge-face through-holes formed on the inner wall surfaces of the core insertion hole.

In addition, concave portions are disposed on inner wall surfaces of the core insertion hole corresponding to sides of the polygonal shape of the core insertion hole. Edge-face through-holes are formed in the concave portions of the inner wall surfaces of the core insertion hole. That is, the edge-face through-holes are positioned in locations separated from the outer circumferential surface of a core to be inserted through the core insertion hole. Accordingly, it is possible to further reduce the possibility of the outer circumferential surface of the core from coming into contact with the edge-face through-holes formed on the inner wall surfaces of the core insertion hole.

Consequently, according to the present invention, there can be obtained the working effect of reducing the possibility of the edge-face through-holes short-circuiting to the core as the result of the outer circumferential surface of the core coming into contact with the edge-face through-holes formed on the inner wall surfaces of the core insertion hole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claim.

What is claimed is:

1. An electronic module comprising:

a multilayer board including:

a core insertion hole having a polygonal shape in plan view;

a multitude of wiring layers;

a plurality of coil wiring patterns formed in positions of the respective wiring layers surrounding the core insertion hole; and concave portions disposed on inner wall surfaces of the core insertion hole corresponding to sides of the polygonal shape, the concave portions extending through the multitude of wiring layers such that a retreated side forming an inner wall surface is formed in each of the concave portions;

a core formed of a magnetic material inserted through the core insertion hole; and edge-face through-holes formed into the inner wall surfaces of the concave portions of the core insertion holes, the edge-face through-holes each forming a concave groove extending into the retreated side of each of the concave portions, each concave groove covered in an electrical conductor to electrically connect the plurality of coil wiring patterns to form a coil, the edge-face through-holes formed such that a space is maintained between the electrical conductor and the core inserted through the core insertion hole.

* * * * *